US005205802A

United States Patent [19]

Swisher

[11] Patent Number: 5,205,802

[45] Date of Patent: Apr. 27, 1993

[54] EXERCISE APPARATUS

[76] Inventor: William J. Swisher, 68 Picadilly Cir., Marlton, N.J. 08053

[21] Appl. No.: 798,809

[22] Filed: Nov. 27, 1991

[51] Int. Cl.[5] ..... A63B 26/00

[52] U.S. Cl. ..... 482/141; 482/49; 482/100; 482/115

[58] Field of Search ..... 482/25, 37, 49, 141, 482/148, 100, 147, 115, 114, 117

[56] References Cited

U.S. PATENT DOCUMENTS

| | | | |
|---|---|---|---|
| D. 212,021 | 8/1968 | Gregory | 482/37 |
| 4,126,308 | 11/1978 | Crumley | 482/148 |
| 4,358,106 | 11/1982 | Shadford | 482/141 |
| 4,538,807 | 9/1985 | Rice | 482/147 |
| 4,610,448 | 9/1986 | Hill | 482/141 |
| 4,763,897 | 8/1988 | Yakata | 482/100 |
| 4,768,778 | 9/1988 | Thomas, Jr. | 482/141 |

FOREIGN PATENT DOCUMENTS

| | | | |
|---|---|---|---|
| 2195551 | 4/1988 | United Kingdom | 482/117 |

*Primary Examiner*—Richard J. Apley
*Assistant Examiner*—Lynne Reichard
*Attorney, Agent, or Firm*—Norman E. Lehrer; Bryan D. Rockwell

[57] ABSTRACT

An exercise apparatus for providing improved muscle conditioning via push-ups or similar exercises. The apparatus comprises an elongated body with end supports and two rotatably affixed hand grips. The elongated body has a plurality of pairs of bushing lined holes. Each hole of each pair is equally spaced from the elongated body's vertical centerline. The hand grips are rectangularly shaped having a pin extension that slidably and rotatably fits in the body's bushing lined holes. The top horizontal portion of the rectangle is an ergonomically shaped handle. The pin and, consequently, the hand grip are locked into place in the body via a spring clip which engages the pin at its free end. The spring clip engages the underside of the body such that the hand grips cannot be withdrawn from the body until the clip is removed. While being used, the user grabs the ergonomically contoured handles and performs a push-up or similar exercise. The invention allows the user to properly space the hand grips for maximum comfort and variation of exercises. While pushing up and returning down, the user can rotate his hands and wrists through a mechanically limited range of motion as demanded by the body's natural tendency to do so during such an exercise.

12 Claims, 2 Drawing Sheets

EXERCISE APPARATUS

BACKGROUND OF THE INVENTION

This invention relates to an exercise apparatus used for obtaining improved muscle conditioning while performing exercises such as push-ups or the like. Exercise is any type of physical activity which employs the muscles of the human body. Exercise is obtained through sports and other physical activity which similarly works the muscles being inclusive of weightlifting, bicycling and running.

There are many types of exercise devices that have been marketed or proposed and which relate specifically to push-ups. In U.S. Pat. No. 4,351,525 to Rosenblad, for example, the invention disclosed is an apparatus to assist the user in performing push-ups. The Rosenblad invention incorporates handle projections which are placed on the floor and grasped by the user. The projections allow the user to obtain increased muscle conditioning by increasing the range of motion through which the user moves by placing the user at a more elevated position. The invention is adjustable for varying exercises and body types, i.e., two separate and identical handles are used and can be positioned as desired. However, the invention does not allow the user to naturally rotate the wrists or hands, seemingly providing a less comfortable and less efficient workout.

U.S. Pat. No. 4,327,907 to DeVries discloses a device for performing push-ups and handstands. The DeVries invention is a one piece continuous tube formed into a semi-circular base and an angled handle portion elevated relative to the base. Similar to Rosenblad, the user grabs the handle portions of two identical devices and performs a push-up, handstand or similar exercise. This invention also features increased range of motion and adjustability but does not allow the hand to rotate in its natural tendency to do so during a push-up exercise.

In Johannson et al., U.S. Pat. No. 4,854,573, an exercise apparatus is disclosed which features means to adjust the height of raised handles, thereby increasing ranges of motion for varying difficulty. The apparatus can be turned to various orientations which change the height of the handles, thereby decreasing or increasing the difficulty of the exercise. The invention is used by placing two identical devices on the floor at the desired distance apart, grasping the handles, and performing a push-up. Adjustability and increased range is available but again, the rotatable feature is lacking.

Finally, in Jenning, U.S. Pat. No. 2,660,640, an exercise stand is disclosed incorporating elevated handles for increased range and having the added feature of being portable and collapsible as well as functioning as a table or foot and leg rest. The stand can be adjusted for various body sizes and exercises but the ability to naturally rotate the hand during the exercise is not a feature.

SUMMARY OF THE INVENTION

The invention in the present application is an apparatus which provides an improved method for doing various types of push-ups. The apparatus provides adjustment means for a variety of user types and features a rotatable hand grip, having a stop device for safety purposes which limits the number of degrees of rotation, for a more natural and effective workout.

In accordance with the invention, the apparatus comprises an elongated body with end supports and tw rotatably affixed hand grips. The elongated body has a plurality of pairs of bushing lined holes. Each hole of each pair is equally spaced from the elongated body's vertical centerline. The hand grips are rectangularly shaped having a pin extension that slidingly and rotatably fits in the body's bushing lined holes. The handle is allowed limited rotation via a stop device located on the underside of the handle portion which engages the side of the apparatus's body. The top, horizontal portion of the rectangle is an ergonomically shaped handle. The pin and the hand grip are locked into position in the body via a spring clip attached to the free end of the pin working in conjunction with the underside of the body. While performing a push-up exercise, the user can rotate his hand and wrist as demanded by the body's natural tendency to do so during the exercise. The problem of overrotation is forestalled by the invention's inherent stop device.

The instant invention has all the advantages of the prior art including raised hand grips for greater range of motion resulting in increased muscle stretch and adjustability in terms of different user sizes and varying exercises. However, the new advantage of the instant invention is one which allows the user to conform to the body's natural tendencies and subsequently obtain a more efficient and comfortable workout by use of the rotational feature. While orientated in the horizontal position and performing the push-up exercise, the user, while pushing up, can rotate the handle grips along with the wrists natural tendency to do so. The similar activity can be performed on the way down. Such rotation allows for comfort not found in other devices which leads to more enjoyment and subsequently better workouts.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODMENT

Figure 1:
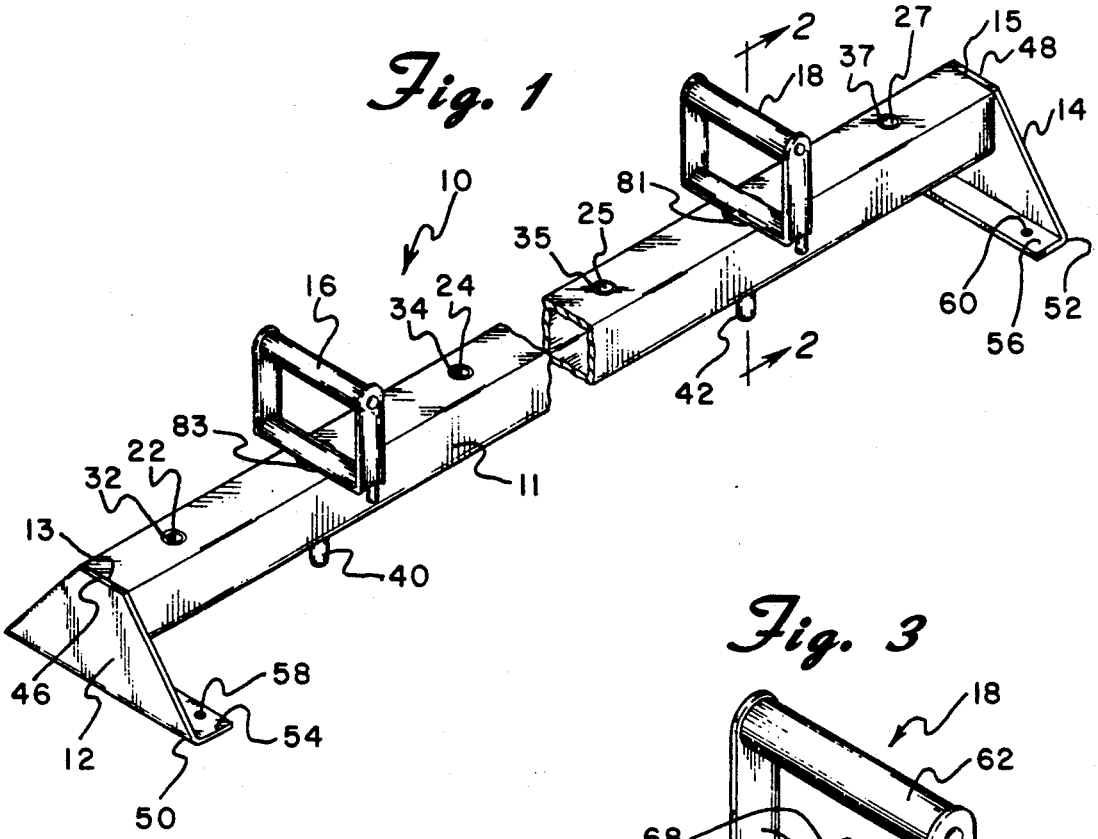
FIG. 1 is a perspective view of the exercise apparatus constructed according to the principles of the present invention.
Figure 3:
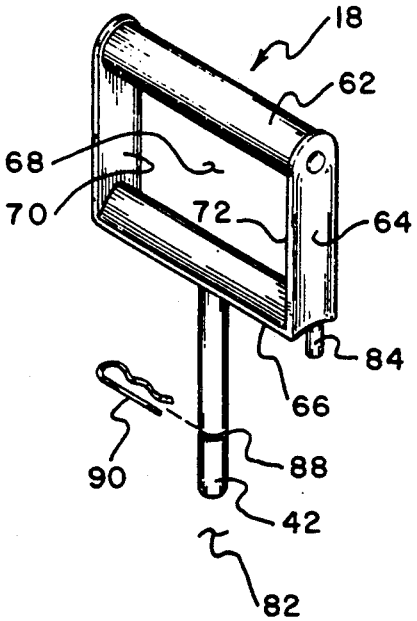
FIG. 3 is a perspective view of the hand grip which forms part of the present invention.

Referring now to the drawings in detail wherein like reference numerals have been used throughout the various figures to designate like elements, there is shown in FIG. 1 a perspective view of an exercise apparatus constructed in accordance with the principles of the present invention and designated generally as 10. The apparatus 10 in FIG. 1 is shown assembled and ready for use.

The exercise apparatus 10 is comprised of an elongated body member 11 having end supports 12 and 14 attached thereto on each end 13 and 15 and hand grips 16 and 18 rotatably affixed thereto at desired positions. The hand grips 16 and 18 can be positioned along the body member 11 such as to provide optimum muscle exercise for different muscles and maximum comfort for varying body sizes.

Figure 2:
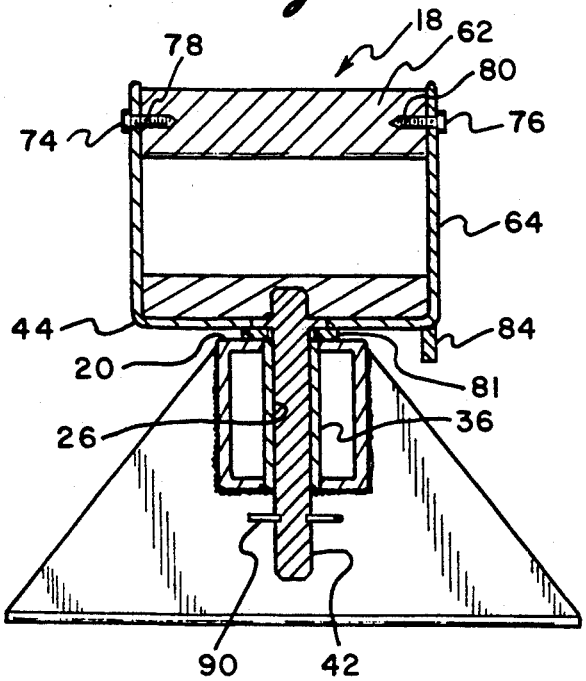
FIG. 2 is a cross-sectional view taken along the line 2—2 of FIG. 1.

Referring still to FIG. 1, the elongated body member 11 is preferably hollow for light weight and is constructed of a rigid material to support the weight of a variety of users. In the preferred embodiment, the body member 11 is comprised of tubular steel or similar metal of approximately two inches in diameter. The body 11 is preferably rectangularly shaped, although other shapes are not excluded, and of a length (3 to 4 feet) to accommodate a variety of exercise positions and a variety of users. The body member 11 has a plurality of openings or holes through the top surface 20 and bottom surface 21 thereof. The openings are even in number, preferably six, and are designated as 22, 23, 24, 25, 26, and 27. These openings are arranged in pairs, 22 and 27, 23 and 26, 24 and 25, such that each opening of a pair is of equal distance from the vertical centerline of the body member 11. The diameter of the holes 22, 23, 24, 25, 26, and 27 are such to accommodate press fit bushings, designated as 32, 33, 34, 35, 36, and 37, each having an inner diameter sufficient to allow slidable and rotatable motion of the pins 40 and 42, which are attached to the hand grips 16 and 18, respectively, along a vertical axis. The bushings are of a length equivalent to the height of the body member 11 so that the ends of the bushings, while press fit, are flush with the top surface 20 and bottom surface 21 of the body member 11 (FIG. 2).

The end supports 12 and 14 are attached to the ends 13 and 15 of the body member 11 via welding, bolts or similar methods. The end supports 12 and 14 facilitate elevation of the body member 11 from the ground to provide clearance. The pins 40 and 42 of the installed hand grips 16 and 18 can be placed in locked position, shown in FIG. 2, such that the horizontal surface 44 of the hand grips 16 and 18, shown here only for hand grip 18, are flush with the top surface 20 of the body member 11. The end supports 12 and 14 are substantially triangularly shaped having their top points removed and forming horizontal surfaces, 46 and 48, as the top edges of each support. The end supports are located relative to said body member 11 such that the horizontal surfaces 46 and 48 are flush with the top surface 20 of the body 11. The bottom edges 50 and 52 of the triangularly shaped end supports are formed at substantially right angles to the vertical portions, forming horizontally extending feet 54 and 56, respectively. The bottom edges or feet extend inwardly towards each other, as shown FIG. 1. The feet 54 and 56 provide greater stability. Each foot also has a pair of holes therein, such as shown at 58 and 60, to provide the option of rigidly affixing the exercise apparatus to the floor or other support surface via screws or bolts.

The hand grips 16 and 18 are substantially identical. Accordingly, only hand grip 18 will be described in detail, it being understood that the following description applies equally to hand grip 16.

The hand grip 18 is substantially rectangularly shaped and is comprised of a handle 62, a substantially U-shaped rigid structure 64 and pin 42. The pin 42 is centered on the horizontal outer surface 44 of the U-shaped rigid structure 64 and integrally attached thereto. The handle 62 is attached to the U-shaped rigid structure 64 at the open end 68 of the "U", between the ends of the vertical sides 70 and 72 of the "U", by screws 74 and 76 thereby completing the rectangular shape. The vertical sides 70 and 72 have appropriate clearance holes therethrough to accommodate he screws 74 and 76. The handle 62 is ergonomically shaped in a rounded manner having threaded holes 78 and 80 centered in each end for engaging the screws 74 and 76. While installed into the body member 11, the hand grip 18 rotates freely and smoothly. This is accomplished by the bushing 36 and a washer 81 through which the pin 42 passes. The washer 81 is located between the horizontal undersurface 44 of the hand grip 18 and the top surface 20 of the body 11, shown best in FIG. 2. The washers 81 and 83, are preferably constructed of a low friction material to allow smooth relative motion between the hand grip and the body.

Figure 4:
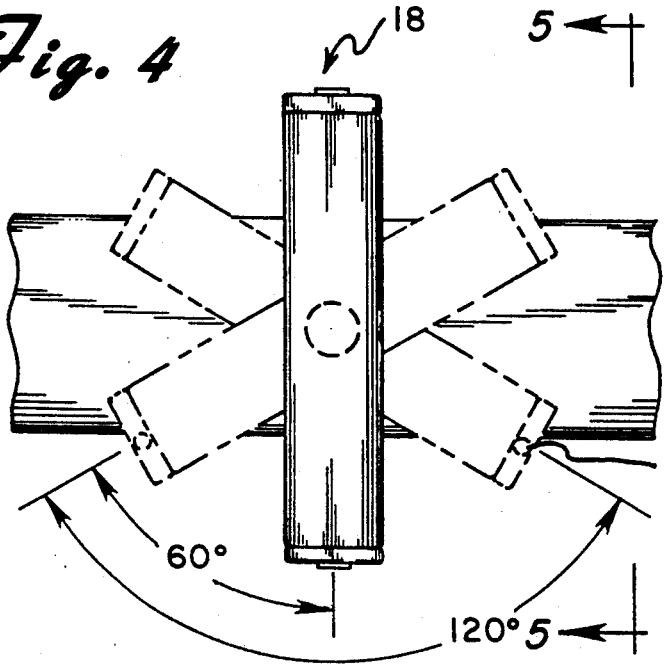
FIG. 4 is an overhead viw of the hand grip while installed and illustrates its rotational and safety stop features.
Figure 5:
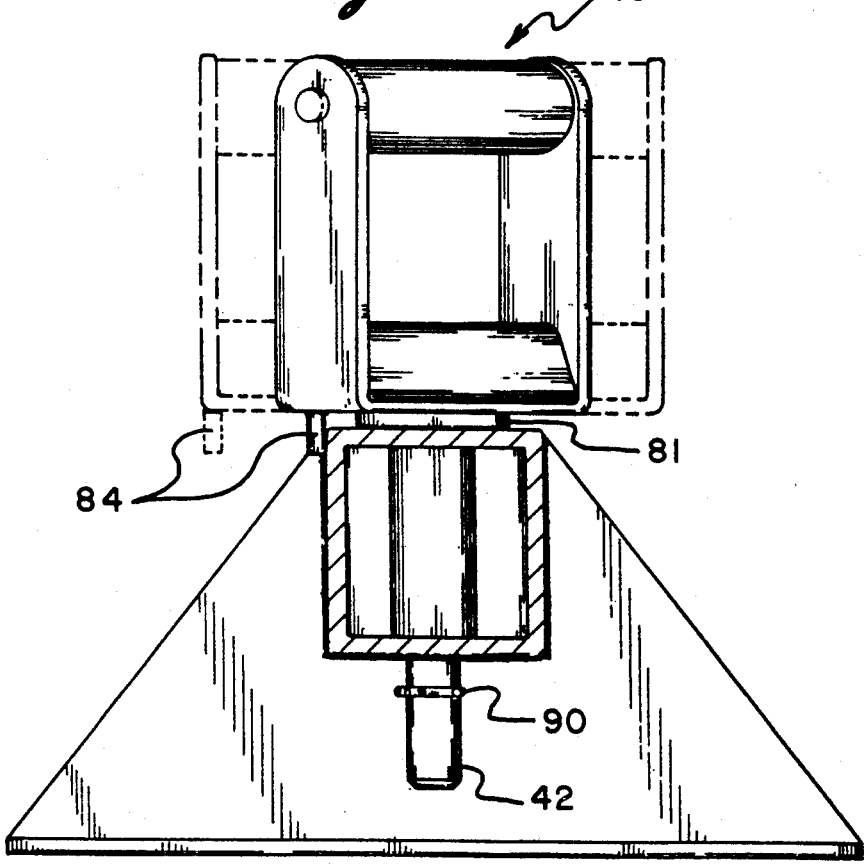
FIG. 5 is a side view of the hand grip in its installed position further illustrating its rotational and safety stop features.

The hand grip 18 has a safety stop pin 84 extending downward from the underside horizontal surface 44 of the U-shaped structure 64. The stop pin 84 is attached via welding at one end of the surface 44. The stop pin feature controls the rotation of the hand grip 18 by interacting with the side of the body 11 thereby limiting rotation of the hand grip to approximately 120°, shown best in FIGS. 4 and 5. The pin 84 is of a length to substantially engage the body 11 to prevent accidental overrotation of the hand grip.

The free end 82 of the pin 42, contains the main part of a locking mechanism which holds the hand grip 18 in place. The free end 82 is tapered at 84 in a conical shape. FIG. 2 shows the hand grip 18 installed into the body of the exercise apparatus. While installed, the pin 42 of the hand grip extends substantially beyond the bottom surface of the body member. At approximately one-half inch from the bottom surface of the body member 22, the pin has a relief diameter 88 for engagement with a spring clip 90. The spring clip 90, while installed, prevents the hand grip 18 from being removed. Upon removing the spring clip, the hand grip 18 can be removed and repositioned on the body 11.

The exercise apparatus 10 is designed essentially for push-ups and is used in the following manner. Referring to FIG. 1, while the apparatus is mounted to or placed on the floor, the user adjusts the hand grips 16 and 18 to the desired position via the openings 22, 23, 24, 25, 26, and 27 and locks them into position via the spring clip 90, all of which is determined by the size of the user and the desired exercise. The user extends to the horizontal position and grasps the handles of the hand grips 16 and 18 and provides enough force to hold his arms in the bent position over the apparatus 10. The user then pushes up, extending his arms and rotating his hands and hand grips 16 and 18, as limited by the safety stop pin 84, to the desired and most natural orientation for maximum comfort and optimum exercise until his arms are fully extended. The user then returns to the original position, rotating his hands and hand grips as desired and repeats the process as desired.

The present invention may be embodied in other specific forms without departing from the spirit or essential attributes thereof and accordingly reference should be made to the appended claims rather than to the foregoing specification as indicating the scope of the invention.

What is claimed is:

1. An exercise apparatus for obtaining improved muscle conditioning comprising a support means and hand grip means, said hand grip means being comprised of an elongated handle attached to a rigid structure having a pin attached thereto, said hand grip means being secured to said support means and being adapted to be grasped by a user, said apparatus having location adjustment means comprised of a plurality of openings through said support means and said pin having a free end fitting slidably and rotatably within said openings, said hand grip means being rotatable through only a limited range of motion of less than 360° about a vertical axis during use of said apparatus, said apparatus having means for locking said hand grip means to said support for preventing unwanted removal and allowing wanted removal of said hand grip means from said support means, said locking means being comprised of a removable spring clip attached tos aid free end of said pin which interacts with the support means.

2. The invention according to claim 1 wherein said openings are spaced in pairs wherein each of said openings of a pair is equally spaced from a vertical centerline of said support means.

3. The invention according to claim 1 wherein said support means is comprised of an elongated body member.

4. The invention according to claim 1 wherein said support means is comprised of an elongated hollow body member and includes end supports attached thereto at opposite ends of said body member.

5. The invention according to claim 1 where in said rigid structure is substantially U-shaped ahving a safety stop means for preventing overrotation of said hand grip.

6. An exercise apparatus for pushups for obtaining improved muscle conditioning comprising a support means and a pair of spaced apart hand grips, said hand grips being comprised of an elongated handle attached to a rigid structure having a pin attached thereto, said hand grips being secured to said support means and being adapted to be grasped by the user, said support means and asid hand grip being capable of supporting the weight of the user doing pushups, said hand grips being rotatable through only a limited range of motion of less than 360° about a vertical axis during use of said apparatus, said support means having means for changing the distance between said hand grips including a plurality of openings therethrough for engaging the pins of said hand grips, said pins fitting slidably and rotatbly within said openings, and locking means for preventing removal of said hand grip means from said support means comprised of removable spring clips for engaging said pins and interacting with said support means.

7. The invention according to claim 6 wherein said openings are arranged in pairs where each of sad openings of a pair is equally spaced from a vertical centerline of said support means.

8. The invention according to claim 6 wherein said support means is comprised of an elongated body member.

9. The invention according to claim 6 wherein said support means is comprised of an elongated hollow body member and includes end supports attached thereto at opposite ends of said

10. The invention according to claim 6 wherein said rigid structure is substantially U-shaped having a safety stop means for preventing overrotation of said hand grip.

11. An exercise apparatus for obtaining improved muscle conditioning comprising a support means and hand grip means, said hand grip means being secured to said support means and being adapted to be grasped by a user and, said hand grip means being rotatable through a limited range of motion about a vertical axis during use of said apparatus, and further including locking means comprised of a removable spring clip adapted to be attached to said hand grip means so as to interact with said support means for preventing unwanted removal and allowing wanted removal of said hand grip means from said support means.

12. An exercise apparatus for pushups for obtaining improved muscle conditioning comprising a support means and a pair of spaced apart hand grip means, said hand grip means being secured to said support means and being adapted to be grasped by a user, said support means and hand grip means being capable of supporting the weight of the user doing pushups, said hand grip means being rotatable through a limited range of motion about a vertical axis during use of said apparatus, and further including locking means comprised of removable spring clips adapted to be attached to said hand grip means so as to interact with said support means for preventing unatned removal and allowing wanted rmeoval of said hand grip means from said support means.

* * * * *